United States Patent [19]

Clem

[11] 4,194,970

[45] * Mar. 25, 1980

[54] METHOD FOR SCREENING PARTICULATE MATERIALS

[75] Inventor: Arthur G. Clem, Des Plaines, Ill.

[73] Assignee: American Colloid Company, Skokie, Ill.

[ * ] Notice: The portion of the term of this patent subsequent to Nov. 21, 1995, has been disclaimed.

[21] Appl. No.: 935,144

[22] Filed: Aug. 21, 1978

Related U.S. Application Data

[63] Continuation-in-part of Ser. No. 768,157, Nov. 21, 1978, Pat. No. 4,126,543.

[51] Int. Cl.[2] ..... B07B 1/28

[52] U.S. Cl. ..... 209/263; 209/266

[58] Field of Search ..... 210/65, 83, 456; 209/261-266, 320, 333, 352

[56] References Cited

U.S. PATENT DOCUMENTS

| | | | |
|---|---|---|---|
| 1,791,245 | 2/1931 | Parliament | 209/266 |
| 3,365,059 | 1/1968 | Hobbs | 209/266 |
| 4,126,543 | 11/1978 | Clem | 209/379 |

OTHER PUBLICATIONS

Taggart, Arthur; Handbook of Mineral Dressing, 1945, section 7.

*Primary Examiner*—Ralph J. Hill

*Attorney, Agent, or Firm*—Mason, Kolehmainen, Rathburn & Wyss

[57] ABSTRACT

A method and apparatus for use in separating oversize from on size particles in a mass of particulate materials passed rapidly through a screening device includes a sloping screen mesh having sizing openings dimensioned to be larger than the desired maximum on size particles intended to pass through the mesh. The screen mesh is supported at a relatively steep slope angle and the cosine of the angle of the slope multiplied times the mesh opening size is set up to be substatially equal to the desired maximum on size particles to be passd through the screen mesh. A particle rebound shield is spaced at a distance in the range of 1.25 to 3 times the diameter of the largest particles fed to the screen above the upper surface of the screen mesh for reflecting and directing particles that bounce off the screen mesk back towards the openings therein. The material flow rapidly over the mesh because of the steep slope angle and the rebound shield insures that the largest on size particles are directed toward the openings in the mesh at least two times per linear foot of screen surfce during their travel through the apparatus to pass through the mesh.

8 Claims, 2 Drawing Figures

METHOD FOR SCREENING PARTICULATE MATERIALS

BACKGROUND OF THE INVENTION

1. Field of the Invention

The present invention relates to a new and improved method and apparatus for separating oversize and on size particles in a mass of particulate material which is passed through a screening apparatus. The method and screening apparatus of the present invention is particularly useful in the oil well drilling industry for removing solid particles, particularly finer sands, from oil well drilling fluids.

2. Description of the Prior Art

In accordance with the prior art, most vibrating screens are mounted with the screen cloth at a slope angle of from 15° to 30° above the horizontal. The material is passed over the upper surface of the screen from top to bottom usually under the influence of gravity alone and the flow is relatively slow because of the relatively shallow angle. The particles that are much smaller than the openings in the screen cloth easily pass through the screen mesh with little difficulty and similarly, the particles that are substantially larger than the screen mesh openings are positively rejected and do not pass through the mesh. These oversize particles move readily along and are eventually taken off the lower end of the screen as oversize. The main problem with prior art screening devices of the character described occurs with the particles of a critical particle size range wherein the particles are just slightly greater in size than the openings in the screen cloth. These critical size particles tend to fall into the open mesh, but because they cannot pass through the openings they become wedged solidly in the mesh causing the screen cloth to become blinded or plugged up. When this occurs, the screening operation is highly inefficient and as more material is passed across the screen, repeated collisions causes the particles to become wedged even more firmly. Cleaning of the screen cloth is then required before operations can be efficiently maintained.

In accordance with the present invention, however, the problem of blinding or wedging of critical size particles in the screen cloth openings is greatly reduced or entirely eliminated and the screening action is greatly speeded up.

In the oil well drilling industry, each gallon of drilling fluid that is pumped from the bottom of a hole is run over "shale-shaker" or coarse mesh screen to remove the large chips, cuttings, shale and coarse sand. The material passing through the "shale-shaker" then runs into a reservoir where the finer materials settle to the bottom and are removed with liquid vacuum cleaners. In accordance with the present invention such vacuum cleaners and the energy expanded through their use are unnecessary since the liquid material containing solid particles from the "shale-shaker" can be conveyed onto the screening apparatus disclosed herein to remove the finer sands commonly removed by a liquid vacuum cleaner. The apparatus of the present invention is self cleaning and does not use energy, as would the liquid vacuum cleaner method.

SUMMARY OF THE INVENTION

It is an object of the present invention to provide a new and improved separating device and method for separating oversize from on size particles in a mass of particulate material flowing across a screening apparatus.

Another object of the present invention is to provide a new and improved separating device and method for separating solid particles from a drilling fluid by providing an inclined screen having a rebound shield disposed thereabove at a distance in the range of 1.25 to 3.0 times the diameter of the largest particles to be screened from the drilling fluid.

Another object of the present invention is to provide a new and improved screening apparatus wherein blinding or wedging of particulate material in the screen openings is not a significant problem.

Another object of the invention is to provide a new and improved screening apparatus wherein particulate material, dry or in a liquid carrier, is handled at a rapid rate and in a highly efficient manner.

Still another object of the invention is to provide a new and improved method and apparatus for screening material wherein the openings in the screen mesh are dimensioned to be considerably larger than the desired maximum on size particles with less chance of plugging up or blinding of the screen cloth yet with little or no oversize particles passing through the screen mesh.

Still another object of the present invention is to provide a new and improved screening apparatus wherein the screen mesh is supported at a relatively steep slope angle thus minimizing the possibility of critical sized particles tending to wedge or lodge in the slightly smaller sized screen openings causing the screen cloth to blind or plug up.

Yet another object of the invention is to provide a new and improved screening apparatus having a shield for rebounding the particles which bounce away from the screen, cloth back toward the screen, said shield disposed at a distance above the screen of 1.25 to 3.0 times the average diameter of the upper 5% of the particles to be screened so that on size particles have numerous chances to pass through the openings in the screen, and particularly so that the particles will impact the screen surface at least two times per linear foot of the screen surface.

The foregoing and other objects and advantages of the present invention are accomplished in a new and improved screening apparatus for use in separating oversize from on size particles in a mass of particulate material passed over a mesh. The method and apparatus is useful for dry screening or for separating solid particles from a liquid mixture, such as a drilling fluid. The apparatus comprises a sloping screen mesh having sizing openings therein dimensioned to be considerably larger than the size of the desired maximum on size particles which are intended to pass through the mesh. The slope of the screen is selected so that the cosine of the slope angle multiplied times the opening size in the screen mesh is substantially equal to the size of the desired maximum on size particles. A particle rebound shield is spaced closely above the upper surface of the screen mesh and the shield repeatedly directs any particles bouncing off the screen mesh back towards the mesh openings in the screen. Because of the steep slope angle and because the openings in the screen cloth are considerably larger than the on size particles passing therethrough, there is little or no tendency for critically sized particles, slightly larger than on size, to become wedged or lodged in the screen cloth as in the prior art screens. In addition, because of the steep slope angle the material moves rapidly down the screen and the rebound shield provides assurance that the on size particles are repeatedly directed back toward the screen mesh so that the on size material passes through the screen and does not flow along with the oversize particles without separation. To achieve the full advantage of the present invention the largest particles to be screened should impact the screen surface at least two times per linear foot of screen surface.

BRIEF DESCRIPTION OF THE DRAWINGS

For better understanding of the present invention, reference should be had to the following detailed description taken in conjunction with the drawings in which.

DESCRIPTION OF THE PREFERRED EMBODIMENT

Figure 1:
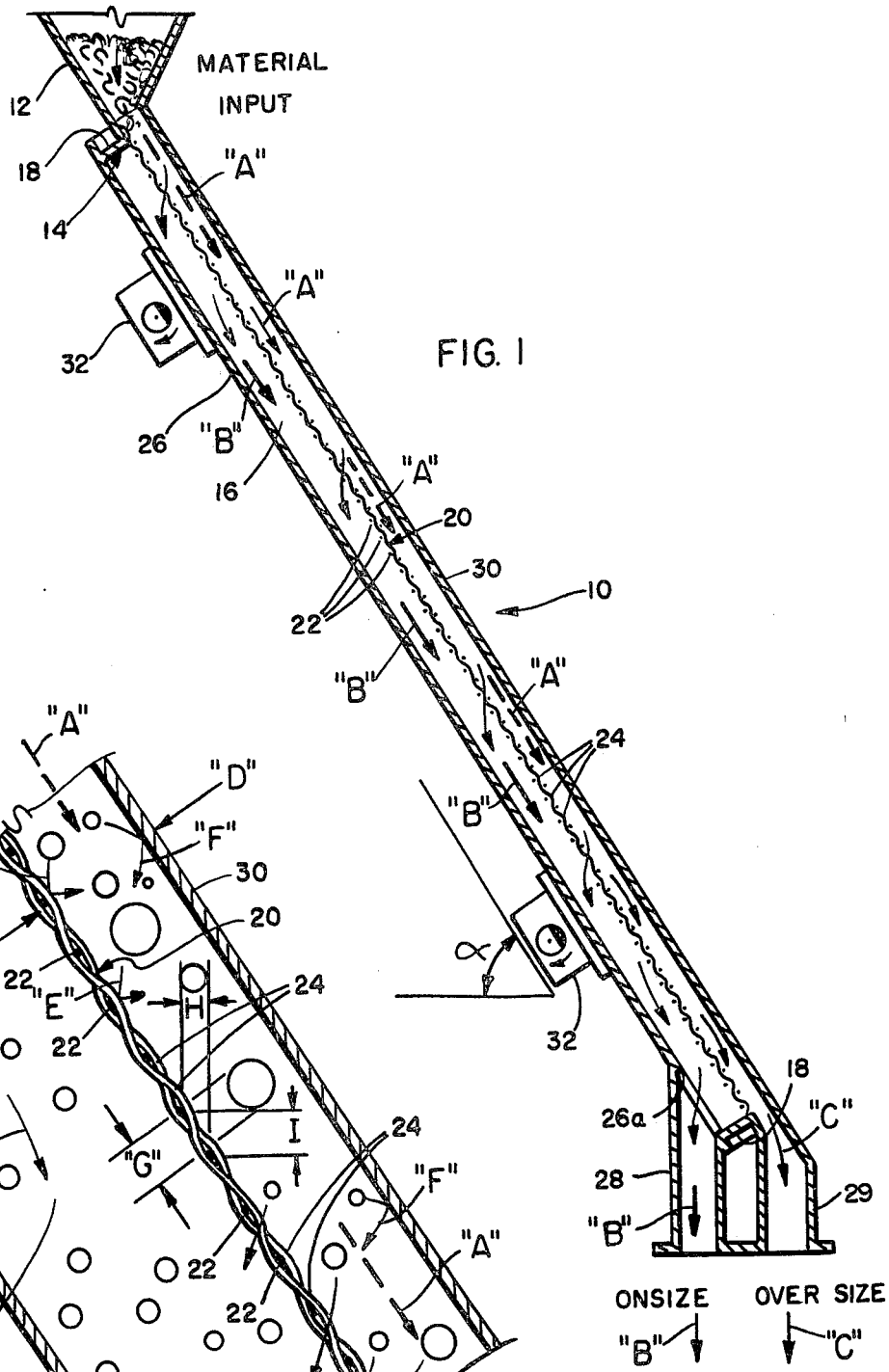
FIG. 1 is a vertical sectional view of a new and improved screening apparatus constructed in accordance with the features of the present invention.
Figure 2:
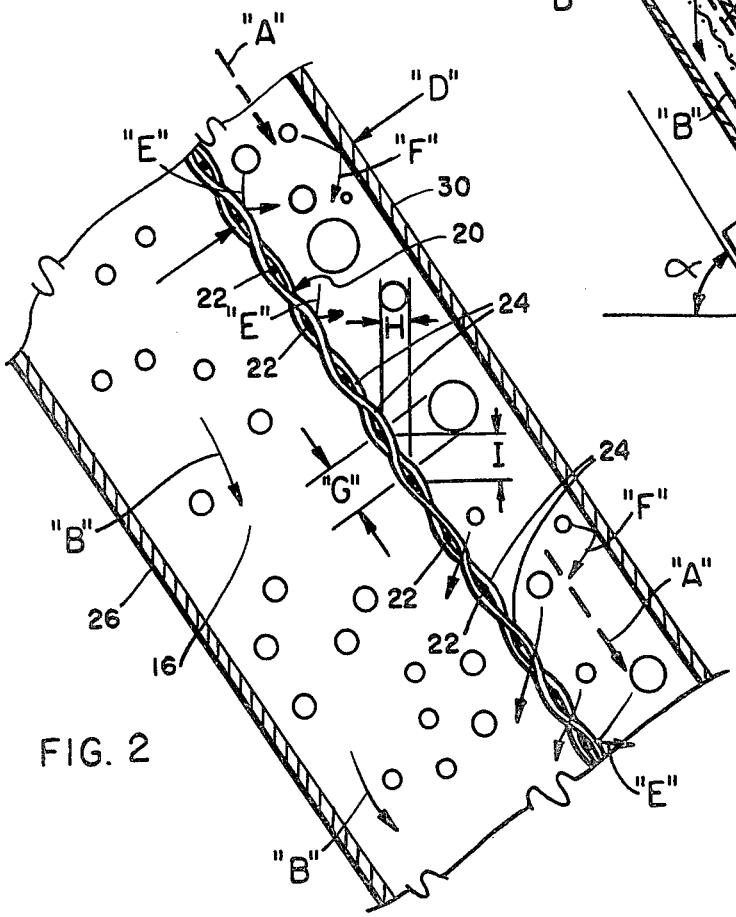
FIG. 2 is an enlarged fragmentary sectional view of the screening apparatus illustrating in animated fashion the action of the particulate material as the particles pass through the apparatus.

Referring now more particularly to the drawings, in FIGS. 1 and 2 is illustrated a new and improved screening apparatus constructed in accordance with the features of the present invention and referred to generally be the reference number 10. Particulate material which is to be treated in the apparatus and which may contain a liquid carrier is introduced into the upper end portion by means of a funnel shaped hopper 12 and flows out of a discharge opening at the lower end of the hopper in a relatively steeply sloped downward path indicated generally by the dotted arrows "A". The screening apparatus includes a rectangular support frame 14 formed of side channels or frame members 16 and upper and lower headers or cross members 18. If required, several intermediate cross members may be provided. The frame 14 provides support for a screen cloth or mesh 20 preferably of the woven type having transverse cross strands 22 and longitudinal strands 24 interwoven to form generally square or rectangular openings for sizing the particles of material. The screen mesh or cloth may be formed of strands of steel, plastic fibre or other material and the diameter of the strands is selected to provide the needed physical strength for the particular application and materials involved.

On the underside of the screen frame 16 there is provided a removable bottom panel 26 for collecting the on size particles of material passing through the openings in the screen cloth or for collecting liquid or liquid and on size particles from which the oversized particles have been removed. The collected material moves downwardly as indicated by the arrows "B" along the underside of the screen. The on size material, or liquid and on size material, eventually reaches the lower end of the apparatus and passes out through a discharge opening 26 a (as shown in FIG. 1) into a discharge chute 28 which is connected to the bottom panel 26.

The particulate material flowing along the upper surface of the screen cloth 20 which does not pass through the mesh and becomes oversize material eventually passes out the lower end of the apparatus into an oversize discharge chute 29 (as indicated by the arrows "C").

In accordance with the present invention, the apparatus is provided with a rebound shield 30 or cover spaced a short distance "D" above the upper level of the screen mesh 20 as best shown in FIG. 2. The closer the rebound shield 30 is spaced from the upper level of the screen mesh 20, the more impacts against the surface of screen mesh 20 a particle will have. Accordingly, the closer the spacing of rebound shield 30 to the upper surface of screen mesh 20, the more efficient the screening due to the increased number of chances for a particle to be accepted if the particle is on size. However, the closer the spacing "D" approaches the diameter of the largest particles to be screened, the greater is the chance for that particle to be caught between the upper surface of screen 20 and the undersurface of rebound shield 30. For perfectly spherical particles, the apparatus of the present invention doubles the screening rate when the distance of separation "D" is an infinitesimal fraction greater than the diameter of the largest sphere to be screened and up to about three times the diameter of the largest sphere. For particles, commonly screened, however, having irregular shapes, it has been found that the full advantage of the present invention is achieved by disposing the lower surface of rebound shield 30 above the upper surface of screen 20 a distance "D" in the range of 1.25 to 3.0 times the average spherical diameter of the largest particles to be screened. Since a small proportion of the particles can be jammed without substantially upsetting the efficiency of the apparatus of the present invention, it has been found that for irregularly shaped particles, the distance "D" should be about 1.25 to 3.0 times the average diameter of the largest 5% of particles to be screened. In this manner, the largest particles will have at least two impacts on the screen surface per linear foot of screen surface to assure efficient and effective separation, as set forth in Table I:

TABLE I

SCREENING EFFICIENCY
ONE (1) INCH DIAMETER PARTICULATE MATTER

| REBOUND SHIELD SPACING | RATIO | IMPACTS PER LINEAR FOOT OF SCREEN |
|---|---|---|
| 1.0 Inch | 1:1 | Subject to jamming |
| 1.25 Inch | 1.25:1 | 4.8 |
| 1.5 Inch | 1.5:1 | 4 |
| 2.0 Inch | 2:1 | 3 |
| 3.0 Inch | 3:1 | 2 |

The distance "D" is selected to insure that the particles of the material which rebound or bounce off the screen cloth strands 22 or 24 as shown by the bent arrows "E" will again and again be deflected and reflected back towards the sizing openings in the screen cloth as indicated by the bent arrows "F" in FIG. 2. Accordingly, as the mixture of on size and oversize particles of material flow along the upper surface of the screen cloth as indicated by the arrows "A", the particles which strike the strands and bounce away repeatedly are deflected back towards the screen cloth again and again so that there is little chance of any sizable portion of the on size material flowing out the oversize discharge chute 29. This is true even though the velocity of the flow is relatively high in comparison with customary low angle screen applications. To additionally aid in the screening action, the screen frame 14 may be provided with one or more vibrator units 32 which cause the screen mesh 20 to vibrate and provide a live screening action for the particles of material. It has been found, however in accordance with the present invention, that extremely good and unexpected separation is achieved even without employing such vibrators on the apparatus of the present invention. When used, the vibrator units preferably are mounted on the side to vibrate the screen cloth 20 back and forth rather than up and down.

In accordance with the present invention, the screen apparatus 10 is mounted in a position with the screen cloth 20 sloping upwardly above the horizon at a relatively steep slope angle indicated by the angle "alpha" in FIG. 1 It has been found that a steep slope angle in the range of approximately 40° to 60° works well and preferably, a slope angle of 45° or greater provides excellent screening action in accordance with the principles of the present invention. The relatively steep slope angle results in a relatively high velocity of flow of the material through the screen apparatus and this is advantageous from a cost standpoint in handling materials.

In accordance with the present invention, a particular size screen cloth 20 is selected so that the horizontal wires 22 are spaced apart by a selected distance or opening size "G" (FIG. 2) which is considerably greater than the maximum size of on size particles of material which are to pass through the screen mesh. The opening size "G" is related to the particular slope angle "alpha" that is used and is also related to the maximum size selected for the on size particles which are to pass through the screen as indicated by the distance "H". This relation is chosen in accordance with the equation wherein the cosine of the angle "alpha" multiplied times the screen opening distance "G" between the cross strands 22 is substantially equal to the maximum size of the on size particles (dimension "H"), which should pass through the screen mesh. For example, if the screen mesh 20 is supported in a horizontal position wherein the angle "alpha" is 0° then the cosine of the angle is equal to 1 and accordingly, the spacing between the strands 22 of the mesh and the maximum size of the on size particles would be the same. When the screen is then elevated to a relatively steep slope angle of 45° or more in accordance with the invention, the distance "G" between the strands 22 of the screen may be chosen to be considerably larger than the maximum size of the on size particles desired (dimension "H"). The steep slope angle decreases the effective size of the openings (the horizontal component) and as an example, the spacing "G" between the cross strands 22 may be selected to be 1.4 to 2.0 times greater than the maximum diameter of an on size particle that is to pass through the screen cloth. A screen cloth having a mesh spacing sized to pass particles of 610 microns or less can be used in accordance with the present invention at a steep angle to effectively screen and separate out particles having a dimension maximum of 420 microns. The steep slope angle of the screen apparatus 10 provides a number of advantages, for example, the feed rates for a given material can be substantially increased over the feed rate for the same material on a screen having a lower slope angle of the same mesh opening size. In addition, with a relatively steep slope angle, the screen cloth becomes self-cleaning because the tendency of the particles of a critical size range (i.e. slightly larger than the maximum size of the on size particles) to become wedged in the screen openings or blind the screen mesh is eliminated or greatly reduced. In the event, however, that a slightly oversize particle does become temporarily wedged in the screen mesh, the continuing impact of the steeply flowing material against the side of the wedged in particle almost always dislodges the wedged particle. The rebound shield 30 is positioned near the upper surface of the screen cloth 20 to permit free downward flow of the particles (arrows "A") and those particles that strike the strands and then bounce off, are repeatedly deflected back to again contact the screen mesh. This increases the effective contact time of the mass of flowing particles against the screen mesh as the particles move from top to bottom even though the particles are moving very rapidly along the screen cloth on the relatively steep slope thereof.

Another feature of the present invention resides in the fact that a particular size of screen mesh 20 may be utilized for providing screening action for several desired particle sizes by changing the angle of slope "alpha" to increase or decrease the horizontal effective screen opening "G". Thus, it is not necessary to change to different mesh size screen cloth each time a different particle size is required. For example, a 30 mesh screen having an opening size of 610 microns may be supported in a 45° slope angle and with this particular angle, the effective opening size of the screen becomes 420 microns which is equivalent of a 40 mesh screen. A further increase of the angle "alpha" to approximately 54° provides an effective screen opening size of 300 microns which is the equivalent of a 50 mesh screen. An increase of the slope angle to 60° further reduces the effective screen opening to 210 microns which is the equivalent of a 70 mesh screen. One screen size can be used to screen many different sizes of particles. The closely spaced rebound shield 30 works in conjunction with the steep slope to provide a greatly increased contact between the flowing particles and the screen mesh than would otherwise be possible with the high overall flow rate. Referring to FIG. 2, even though the effective vertical opening in the screen mesh 20 (dimensioned as indicated by the letter "I") is somewhat greater than the desired maximum size of the on size particles to pass through the screen mesh there is little chance of such oversize particles passing through the mesh and this is because of the parallel direction of flow generally along the screen (as indicated by the arrows "A"). The close spacing of the rebound shield 30 and its generally parallel orientation relative to the screen causes the particles to rebound in a generally downward direction at a relatively steep angle incident to the surface of the screen cloth so that only the smaller on size particles pass through the larger size screen openings. The problem of wedging or blinding of the screen cloth in the apparatus 10 is thus virtually eliminated, high flow rates are possible, and a highly efficient screening action results.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A method of screening materials including solid particles to separate on size and oversize particles comprising the steps of:

rapidly flowing said material including said solid particles downwardly along an upper surface of a screen mesh sloped at an angle in the range of 40°-60° with respect to horizontal and having openings larger than a predetermined maximum dimension desired for on size particles intended to pass through said mesh; and repeatedly redirecting particles of said flowing material that are bouncing away from said screen mesh back toward said openings in said screen mesh by bouncing said particles off a substantially impervious rebound shield spaced above and substantially parallel to the upper surface of said screen mesh at a distance in the range of greater than one and not more than three times the diameter of the largest particle screened.

2. The method of claim 1 wherein the spacing of rebound shield from the upper surface of the screen mesh is in the range of 1.25 to 3.0 times the diameter of the largest particle to be screened.

3. The method of claim 1 wherein said spacing is in the range of 1.25 to 3.0 times the diameter of the largest 5%, by number, of the particles screened.

4. A method as defined in claim 1 wherein said material screened is drilling fluid.

5. A method as defined in claim 4 wherein said solid particles include sand particles.

6. A method of screening materials including solid particles to separate on size from oversize particles comprising the steps of:

rapidly flowing said material including said solid particles downwardly along an upper surface of a screen mesh sloped at an angle of at least 45° with respect to horizontal and having openings larger than a predetermined maximum dimension desired for on size particles intended to pass through said mesh; and repeatedly redirecting particles of said flowing material that are bouncing away from said screen mesh back toward said openings in said screen mesh by bouncing said particles off a substantially impervious rebound shield spaced above and substantially parallel to the upper surface of said screen mesh at a distance in the range of greater than one and not more than three times the diameter of the largest particle screened.

7. The method of claim 6 wherein the spacing of the rebound shield from the upper surface of the screen mesh is in the range of 1.25 to 3.0 times the diameter of the largest particle to be screened.

8. The method of claim 6 wherein said spacing is in the range of 1.25 to 3.0 times the diameter of the largest 5%, by number, of the particles screened.

* * * * *